US007828283B2

(12) United States Patent
Learmonth et al.

(10) Patent No.: US 7,828,283 B2
(45) Date of Patent: Nov. 9, 2010

(54) SHEET FEED METHOD AND APPARATUS INCLUDING PIVOTALLY MOUNTED PICK ARM

(75) Inventors: Murray Learmonth, Temecula, CA (US); William H. Schwiebert, Poway, CA (US); Tsai-Yi Lin, ShenKeng Shiang (TW); Dentarg Huang, Yonghe (TW)

(73) Assignee: Hewlett-Packard Development Company, L.P., Houston, TX (US)

( * ) Notice: Subject to any disclaimer, the term of this patent is extended or adjusted under 35 U.S.C. 154(b) by 86 days.

(21) Appl. No.: 11/780,460

(22) Filed: Jul. 19, 2007

(65) Prior Publication Data

US 2009/0020940 A1 Jan. 22, 2009

(51) Int. Cl.
*B65H 3/06* (2006.01)

(52) U.S. Cl. ..... 271/117; 271/109

(58) Field of Classification Search ..... 271/109, 271/117, 127, 149; 347/104
See application file for complete search history.

(56) References Cited

U.S. PATENT DOCUMENTS 6,257,569 B1 7/2001 Rhodes
6,318,715 B1 * 11/2001 Froechte et al. ..... 271/117
6,443,445 B1 9/2002 Bortolotti
6,503,010 B2 * 1/2003 Jeong ..... 400/629
6,547,236 B1 4/2003 Yip
6,626,595 B2 9/2003 Kabamoto
6,637,743 B2 * 10/2003 Underwood et al. ..... 271/117
6,648,322 B2 11/2003 Park
6,659,449 B2 12/2003 Kim
6,672,581 B2 1/2004 Lee
6,685,183 B2 2/2004 Kim
6,866,259 B2 * 3/2005 Underwood et al. ..... 271/117
6,874,776 B2 4/2005 Gaarder
6,896,254 B2 * 5/2005 Koh et al. ..... 271/117
6,988,722 B2 1/2006 Su
7,036,813 B2 * 5/2006 Asada ..... 271/117
7,093,830 B2 * 8/2006 Kang ..... 271/118
7,204,483 B2 4/2007 Mo
7,225,697 B2 6/2007 Schalk
7,370,857 B2 * 5/2008 Otsuki ..... 271/114
7,384,033 B2 * 6/2008 Asada ..... 271/114
7,413,183 B2 * 8/2008 Asada et al. ..... 271/117
7,677,556 B2 * 3/2010 Murayama et al. ..... 271/162
7,744,209 B2 * 6/2010 Nakashima ..... 347/104

* cited by examiner

*Primary Examiner*—Richard W Ridley
*Assistant Examiner*—Jeremy Severson

(57) ABSTRACT

Various embodiments of a sheet feed apparatus for an electronic device are disclosed. The sheet feed apparatus includes a mount pick arm that pivotally moves closer to a stack of media as the media is picked from the stack of media. A pick arm is pivotally connected to the mount pick arm and picks media from the stack of media.

17 Claims, 5 Drawing Sheets

SHEET FEED METHOD AND APPARATUS INCLUDING PIVOTALLY MOUNTED PICK ARM

BACKGROUND

Some electronic devices, such as printers, copiers and scanners, feed sheets of media from a stack of media. The number of sheets of media or stacking height of the media is limited in many of these electronic devices.

DETAILED DESCRIPTION

Exemplary embodiments are directed to apparatus, systems, and methods for feeding and transporting media. An articulating sheet feed apparatus has improved pick reliability. In one embodiment, a pick arm pivotally connects to an articulating mount pick arm that is movable with respect to a stack of media. The mount pick arm moves to accommodate different thicknesses of the stacked media. The mount pick arm includes one or more spacer wheels that are registration points for a top sheet of media to ensure a consistent pick geometry throughout a full height of the media stack. As media is picked from the stack, the mount pick arm advances toward the media so the pick arm maintains a consistent distance for picking each successive piece of media.

In one embodiment, a mount pick arm lock prevents the mount pick arm from moving away from the media. By way of example, the pick arm lock is actuated from a rocker gear that engages a sheet feed mechanism. Locking of the mount pick arm occurs when the electronic device is instructed to pick a new sheet of media. The rocker gear engages and causes die pick arm lock to operate.

Figure 1:
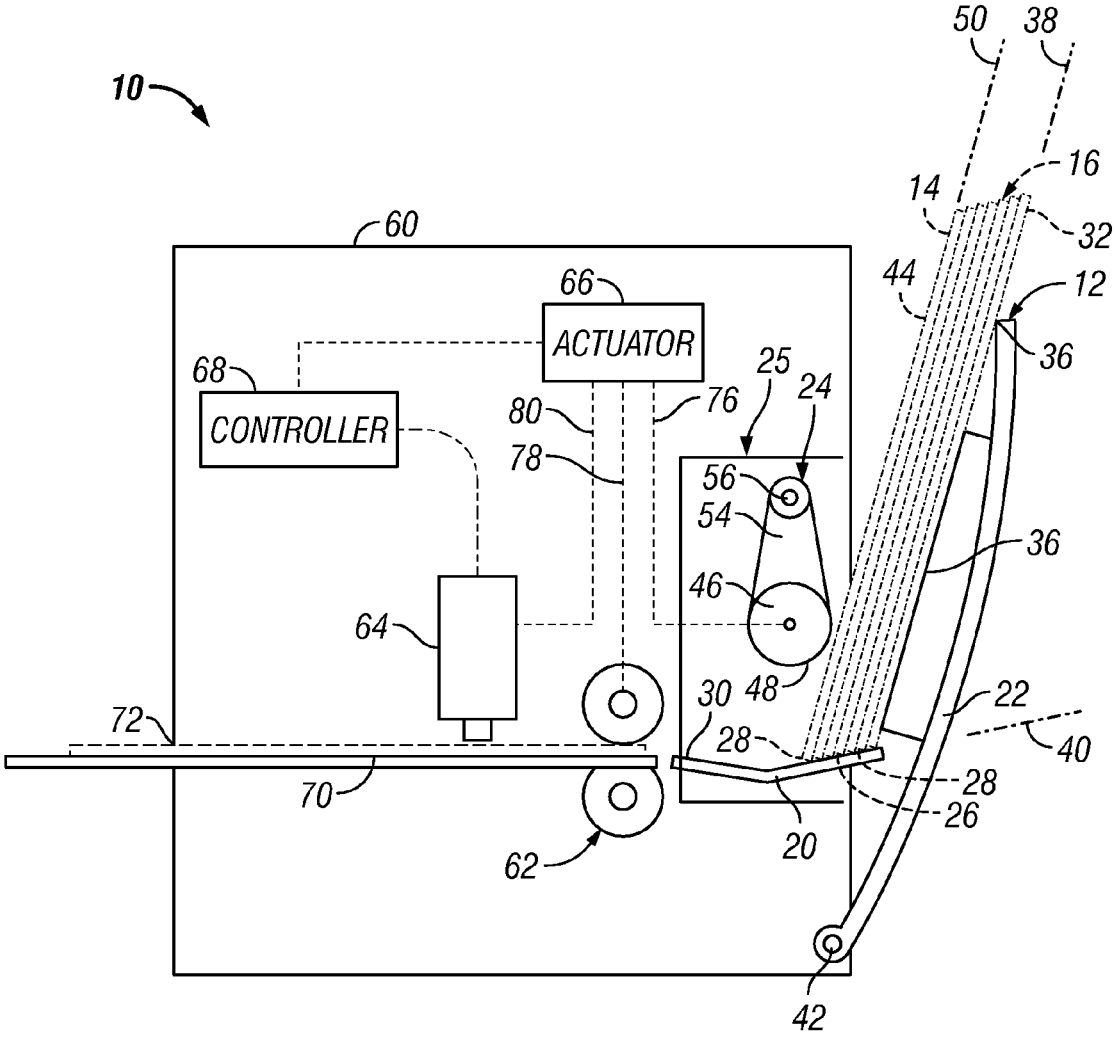
FIG. 1 is a side view of an electronic device including a sheet feed apparatus according to one exemplary embodiment.

FIG. 1 schematically illustrates an electronic device 10 that includes a sheet feed apparatus 25 according to one exemplary embodiment. In the example shown, electronic device 10 comprises a printer configured to print or otherwise form images upon sheets 14 that are arranged as a stack 16 and individually fed by a sheet feed apparatus 25. The medium can be formed from a variety of one or more different materials such as cellulose-based materials, polymers, and combinations thereof. The sheets can also have various sizes and shapes. Examples of sheets include photo media, card stock, paper, transparencies, magnetic panels and the like, to name a few examples.

Sheet feed apparatus 25 feeds individual sheets 14 of media from a stack 16 in a tray 12 to electronic device 10. Sheet feed apparatus 25 includes floor 20 and sheet pick device or pick arm 24, and the tray 12 includes a backrest 22.

Floor 20 comprises a member supported below backrest 22 and is configured to provide a surface 26 against which edges 28 of sheets 14 rest. In the particular example shown, floor 20 further provides a transition surface 30 angled with respect to surface 26 such that movement of edge 28 of a sheet 14 along surfaces 26 and 30 results in the sheet of media being reoriented. Surface 26 is substantially smooth and has a low coefficient of friction such that edges 28 of sheets 14 are less likely to be damaged when being picked by pick arm 24. At the same time, however, due to the geometry of the components of sheet feed apparatus 25, individual sheets 14 can be reliably separated and picked from slack 16 in tray 12 by the pick arm 24.

Backrest 22 comprises one or more members configured to support stack 16 upon floor 20 in an inclined orientation. In particular, backrest 22 is configured to bear against and support a rear face 32 or rearward most sheet 14 of stack 16. Backrest 22 includes one or more surfaces 36 that contact face 32 and generally extend in a common linear plane 38. Plane 38 intersects plane 40 in which surface 26 extends. Planes 38 and 40 are angularly spaced such that pick device 24 may pick and separate individual sheets 14 from stack 16.

As further shown by FIG. 1, backrest 22 is pivotally supported for rotation about axis 42. In one embodiment, backrest 22 serves as a door by covering openings of device 10, including openings between pick arm 24 and floor 20, when backrest 22 is in the closed or retracted position. In other embodiments, backrest 22 is fixed relative to the remainder of device 10 so as to be stationary and permanently extend in the in-use position shown in FIG. 1.

Pick arm 24 comprises a device configured to engage a front face 44 of a frontward-most sheet 14 of stack 16 so as to urge stack 16 against backrest 22. Pick arm 24 is also configured to move or drive the frontward-most sheet 14 in a direction generally parallel to plane 38 such that edge 28 of a frontward-most sheet 14 moves along surfaces 26 and 30 into device 10. In the particular example shown, pick arm 24 includes a rotatably driven cylinder or pick tire 46 that provides a media driving surface 48 that contacts face 44. In particular, face 44 and the frontward-most sheet 14 of stack 16 generally extend in a plane 50 that is substantially parallel to plane 38. Media driving surface 48 contacts face 44 at a location within plane 50 that is spaced from an intersection of plane 50 and plane 40 by a distance such that media driving surface 48 applies a force to face 44 so as to pick and separate the frontward-most sheet 14 of stack 16 from the remaining sheets 14 of stack 16.

Although media driving surface 48 is illustrated as being provided by a cylindrical drive member or roller 46, media driving surface 48 can alternatively be provided by other members and mechanisms. For example, media drive surface 48 can be provided by multiple rollers that are coaxial or axially spaced from one another. In still other embodiments, media driving surface 48 is provided by belts or other endless members that rotate about multiple axes and that contact face 44 of the frontward-most sheet 14 of stack 16.

As further shown by FIG. 1, pick arm 24 additionally includes support 54. Support 54 comprises an elongate member, such as an arm, configured to pivotally support media driving member 46 for rotation about axis 56. In one embodiment, support 54 is resiliency biased, such as by a coil spring or leaf spring so as to urge media driving member 46 towards backrest 22.

In the particular example shown in FIG. 1, sheet feed apparatus 25 is illustrated as being incorporated as part of an electronic device 10 comprising a printer. In addition to sheet feed apparatus 25, electronic device 10 includes housing 60, media transport 62, image-forming device 64, actuator 66 and controller 68. Housing 60 includes one or more structures, such as panels, which are configured to substantially enclose and support the remaining components of device 10. Housing 60 forms an opening between backrest 22, pick device 24 and floor member 20 through which sheets 14 of the media are input. Housing 60 further forms a media path 70 along which sheets 14 of the media travel relative to image-forming apparatus 64 and out discharge opening 72. In the particular example shown, backrest 22 functions as a cover for housing 60.

Media transport 62 comprises a mechanism that engages and drives sheets 14 of media along media path 70 relative to image-forming device 64 and out discharge opening 72. Media transport 62 receives an individual sheet 14 picked by pick device 24 and drives the individual sheet 14 as shown in phantom in FIG. 1. Although media transport 62 is schematically illustrated as a pair of opposite rollers, wherein at least one of the rollers is rotatably driven, media transport 62 can comprise multiple rollers coaxial with one another or axially spaced from one another. Media transport 62 can also alternatively comprise one or more endless members or belts driven about a plurality of axes and configured to engage and drive individual sheets 14 along media path 70.

Image-forming device 64 comprises a device configured to form an image, such as text, a photograph and the like, upon at least one lace of an individual sheet 14. In the particular example shown, image-forming device 64 includes one or more printheads that deposit ink upon a sheet 14. The one or more printheads can be stationarily supported, such as in a page-wide array printhead or can be movably supported by a carriage (not shown). In still other embodiments, other image-forming devices can be employed such as electrophotographic printing devices that utilize one or more electrically charged surfaces to apply dry or liquid toner to a surface of a sheet 14 of media or such as dye sublimination printers and the like.

Actuator 66, schematically shown, comprises a device that drives the sheet feed apparatus 25 (see FIGS. 2-5), media transport 62 and a carriage (not shown) of image-forming device 64. In one embodiment, actuator 66 comprises one or more electrically powered motors operably coupled to media drive member 46, media transport 62 and image-forming device 64 via power trains 76, 78 and 80, respectively. Power trains 76, 78 and 80 can include one or more gears, pulleys, belts, chains, sprockets and the like by which mechanical power is transmitted from actuator 66. In other embodiments, actuator 66 utilizes other electrical, pneumatic, hydraulic actuators for providing mechanical power to drive member 46, transport 62, or device 64.

Controller 68 comprises a processing unit that generates control signals for directing actuator 66 and image-forming device 64. For purposes of this disclosure, the term "processing unit" means a conventionally known or future developed processing unit that executes sequences of instructions contained in a memory. Execution of the sequences of instructions causes the processing unit to perform steps such as generating control signals. The instructions can be loaded in a random access memory (RAM) for execution by the processing unit from a read only memory (ROM), a mass storage device, or some other persistent storage. In other embodiments, hard wired circuitry can be used in place of or in combination with software instructions to implement the functions described. Controller 68 is not limited to any specific combination of hardware circuitry and software, nor to any particular source for the instructions executed by the processing unit.

In operation, controller 68 generates control signals that direct actuator 66 to drive sheet feed apparatus 25 (including the media drive member 46 and the mount pick arm) so as to pick an individual sheet 14 from stack 16. Media driving member 46 is rotatably driven until edge 28 of the frontward-most sheet 14 is engaged by media transport 62. Controller 68 further generates control signals directing actuator 66 to drive media transport 62 so as to move the picked sheet 14 of media relative to image-forming device 64. Controller 68 generates control signals directing image-forming device 64 to print or otherwise form an image upon face 44 of sheet 14. Thereafter, the printed-upon sheet 14 is discharged through discharge opening 72.

Figure 2:
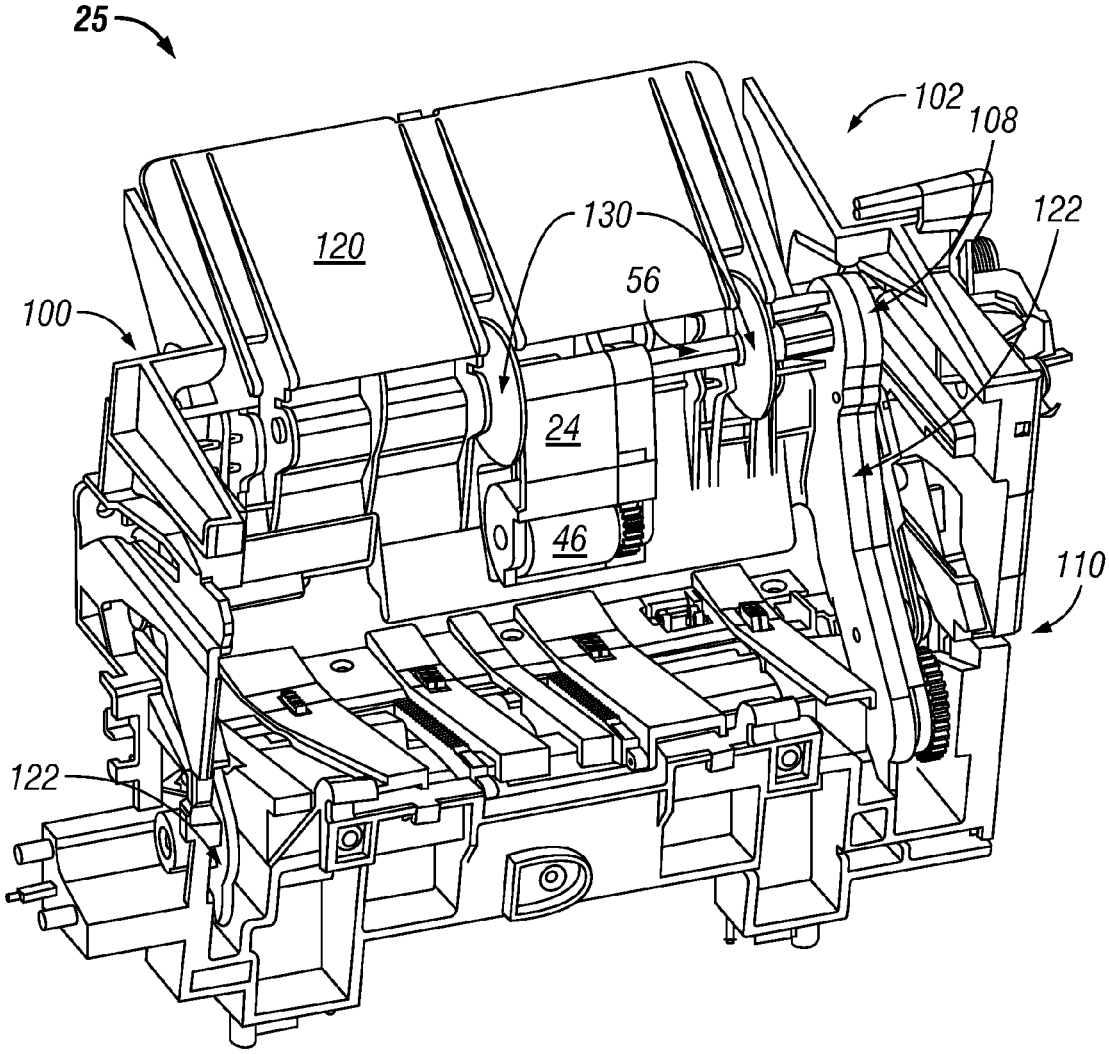
FIG. 2 is a perspective view of the sheet feed apparatus according to one exemplary embodiment.
Figure 3:
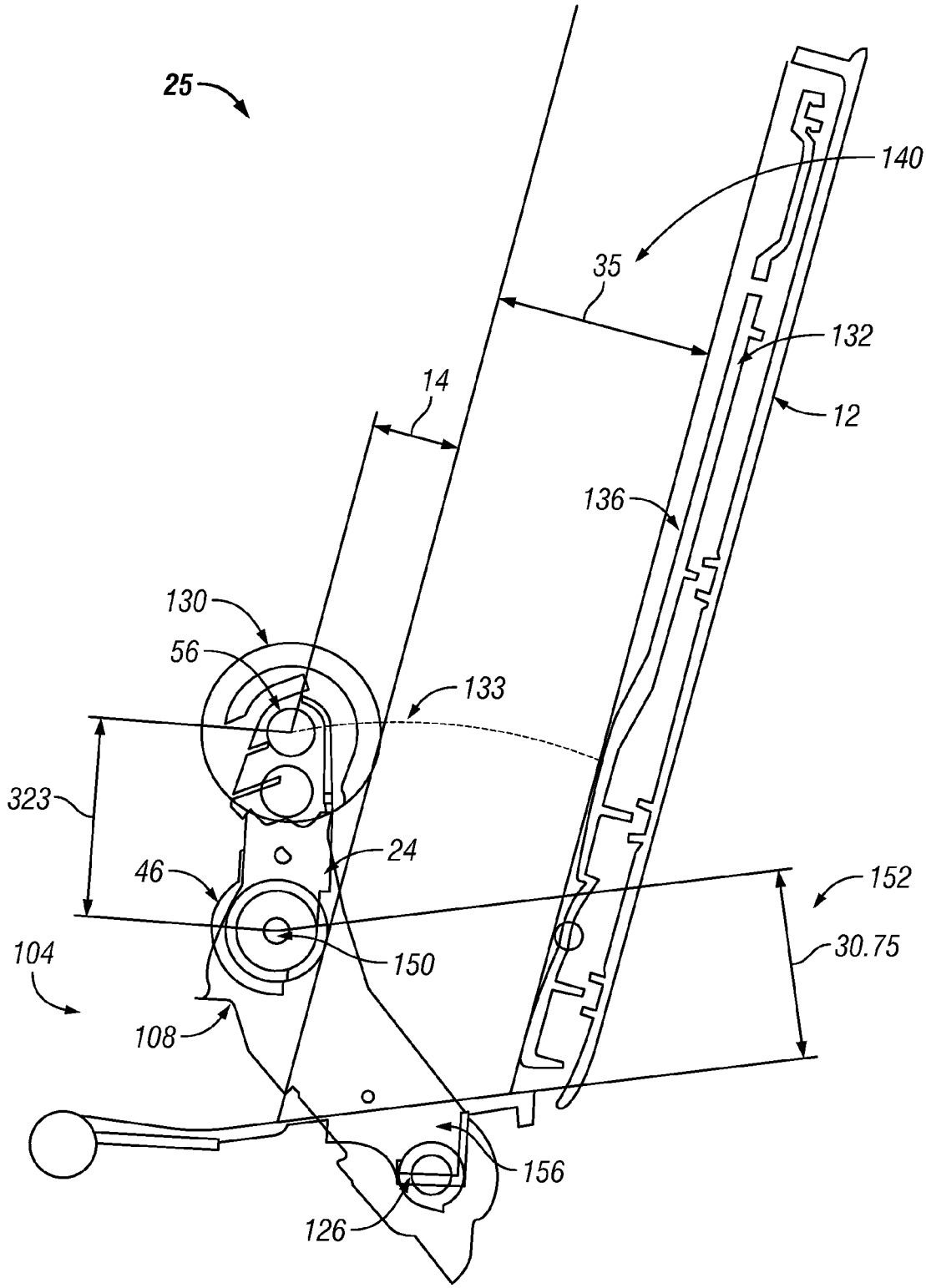
FIG. 3 is a side view of a pick system according to one exemplary embodiment.
Figure 4:
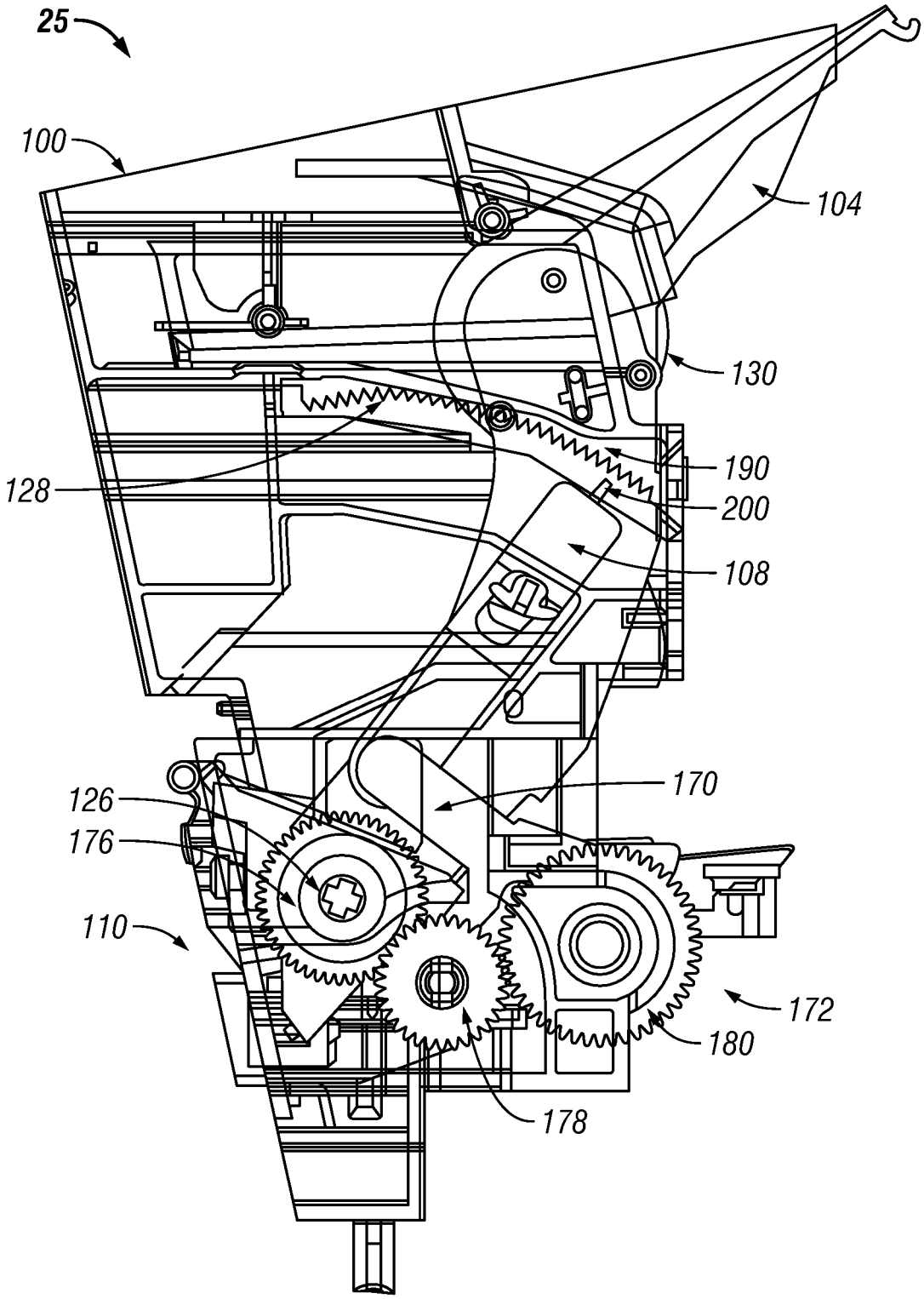
FIG. 4 is a side view of the sheet feed apparatus showing a locking mechanism according to one exemplary embodiment.

FIGS. 2-4 show an exemplary embodiment of a sheet feed apparatus or system 25. The sheet feed apparatus 25 includes one or more of a media box 100, a pick arm assembly 102, and sheet feed gear system 110. The pick arm assembly 102 includes a mount pick arm 104, pick arm 24, and mount pick arm lock 108.

The mount pick arm 104 includes a generally rectangular or square body 120 with two oppositely disposed and parallel arms 122. The arms 122 extend outwardly from the body 120 and rotatably or pivotally attach to a body of the electronic device at an axis 126. The body is able to rotate about axis 126 in order to move pick arm 24 towards and away from the stack of media. The media box 100 includes a curved opening 128 through which a portion of the mount pick arm 104 travels.

The mount pick arm 104 includes one or more spacer wheels 130 that rotate about axis 56. The spacer wheels are spaced apart with the pick arm 24 disposed between the two wheels. In one embodiment, the spacer wheels 130 rest on a top sheet of media. As the stack of media moves, the mount pick arm 104 simultaneously moves or follows the stack of media. For example during a print operation, as sheets of media are removed from the media box 100, the mount pick arm 104 moves toward an inner tray 132 of tray 12. By contrast, as sheets of media are added to the media box 100, the mount pick arm moves away from the inner tray 132.

In one embodiment, the mount pick arm 104 moves between a first or extended position and a second or retracted position. In the first position, the mount pick arm 104 is adjacent the inner tray 132 such that the spacer wheels 130 abut an outer surface 136 of the inner tray 132 (example, when the media box 100 does not include any media). In the second position, the mount pick arm 104 is displaced away from the outer surface 136 of the inner tray 132. For example, FIG. 3 shows an outer surface of the spacer wheel 130 displaced a distance equivalent to a media stack height 140.

The sheet feed apparatus 25 can be configured to accommodate a wide range media stack heights. By way of example, FIG. 3 shows exemplary dimensions and ranges for the sheet feed apparatus 25. As shown, the mount pick arm 104 is in an extended position from the inner tray 132 and is able to move or rotate along an arc 133. In this position, the media stack height 140 is about 35 millimeters (mm) or large enough to accommodate about a 100 sheet photo capacity. The spacer wheel 130 rotates about axis 56 and has a radius of about 14 mm. The pick arm 24 extends between a first axis 56 and a second axis 150 about which the pick tire 46 rotates and has a length of about 32.3 mm. Further, a media buckle length 152 of about 30.75 mm extends between axis 150 and top surface of a transition plate 156.

In one exemplary embodiment, the spacer wheels 130 contact the outer piece of media (i.e., farthest from the inner tray 132) and provide a registration point for the top sheet of media. As such, the spacers wheels assist in providing a consistent pick geometry throughout a full height of the stack of media. By way of example, as media is picked from the stack, the mount pick arm 104 advances toward the inner tray 132. The angle of the pick arm 24 with respect to the media remains consistent or constant while successive pieces of media are picked and removed from the stack of media. In this manner, the sheet feed apparatus 25 picks each media with a consistent force. For instance, the pick tire 46 engages each piece of media in a stack with a consistent force and geometry (example, angle of engagement) since the mount pick arm and pick arm move toward the media. In one embodiment, the mount pick arm 104 advances or moves an amount equal to a thickness of the picked media.

The pick arm assembly 102 includes two separate components (the pick arm 24 and the mount pick arm 104) that articulate with respect to each other at two different and separate pivot locations. A first pivot location occurs along axis 56 for one end of the pick arm 24, and a second pivot location occurs along axis 126 for each end of arms 122. As such, the pick arm 24 is connected to and travels with the mount pick arm 104. The two piece configuration of the pick arm assembly 102 enables the pick arm 24 to move, swing, or rotate through a larger radius (example as opposed to a pick arm that is stationary with respect to the mount pick arm). The mount pick arm 104 follows a thickness of the media stack using the sheet feed gear system 110. Thus, an angel of the mount pick arm 104 with respect to the inner tray 132 varies. Further, because the mount pick arm 104 is pivotally supported about axis 126, pick arm 24 accommodates different stacks of media having different overall thicknesses.

Figure 5:
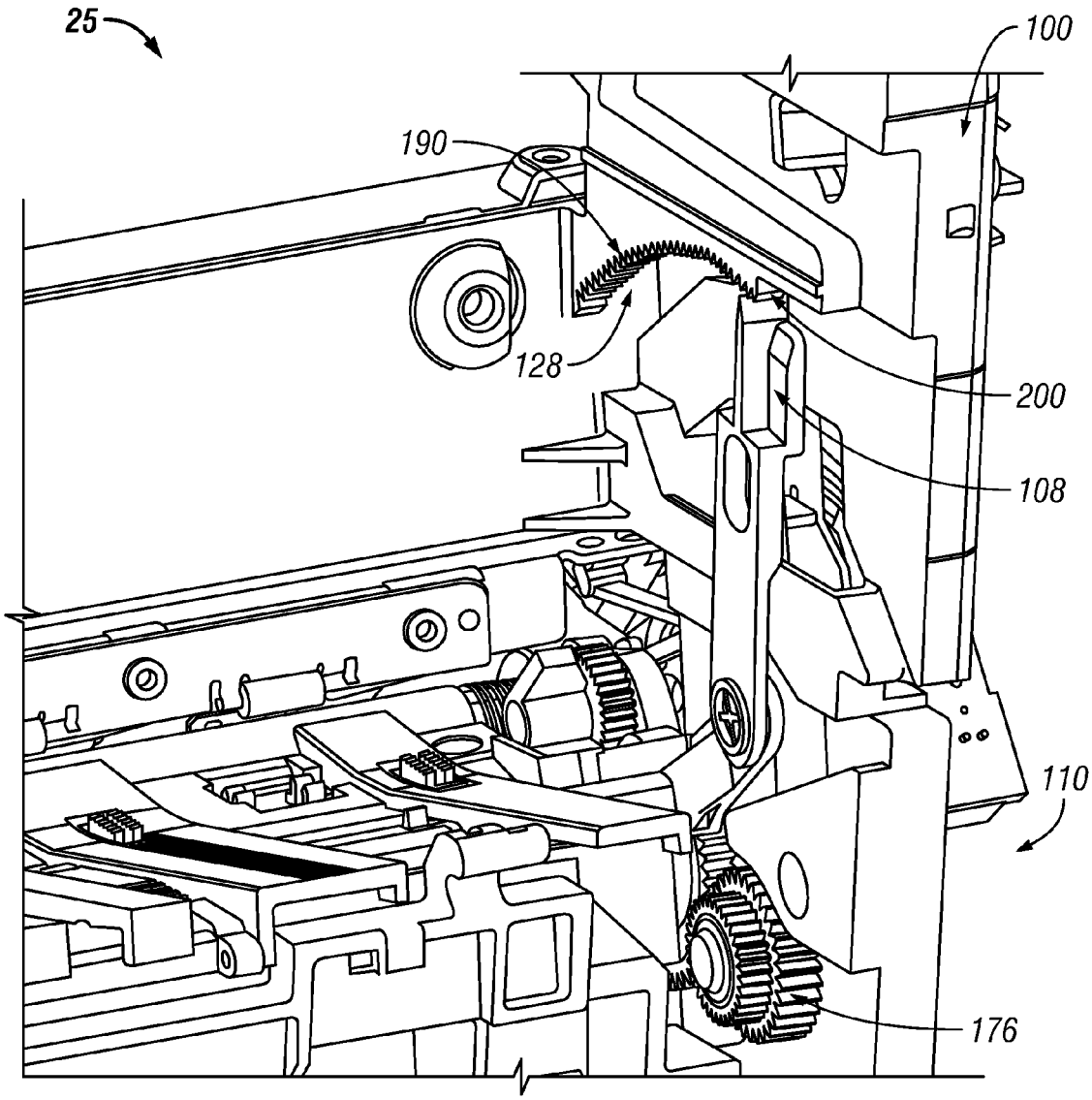
FIG. 5 is a perspective view of the mount pick arm lock according to one exemplary embodiment.

FIGS. 4 and 5 show the sheet feed gear system 110 in more detail. As shown, the sheet feed gear system 110 includes one or more of a mount pick arm lock 108, a locking plate 170, and a gear assembly 172. By way of example, the gear assembly includes a sheet feed gear 176, a second gear 178, and a rocker gear 180. The media box 100 includes a plurality of teeth 190 formed along an arcuate opening 128. The sheet feed gear assembly generates a torque for compensating and adjusting a feeding force while picking the media and transmits sheet feeding mechanical energy through the mount pick arm to the pick arm.

When the electronic device initiates a pick of media, a locking system locks the mount pick arm and prevents it from moving. By way of example, the locking plate 170 moves upwardly to move the mount pick arm lock 108 to engage teeth 190 formed in the body of the media box 100. By way of example, one end of the mount pick arm lock 108 includes an end 200 shaped and sized to fit between adjacent teeth 190 and prevent the mount pick arm 104 from moving. In this manner, the mount pick arm 104 remains stationary during a pick of media from the media stack. As such, a position of the pick arm 24 remains stable during media pick and transportation.

In one embodiment, the mount pick arm lock 108 is directly actuated from the rocker gear 180 that engages the sheet feed mechanism. This configuration overcomes any specific timing issues by ensuring the pick does not occur before the mount pick arm 104 is in the fixed position. In other words, the rocker gear engages to lock the pick arm in a stable position during media transportation at the instant in time when the sheet feed gear train is actuated. When the sheet feed gear train is engaged, the sheet feed apparatus 25 simultaneously locks the position of the mounting pick arm 104 and pick arm 24.

Although sheet feed apparatus 25 has been illustrated as being utilized as part of an electronic device 10 comprising a printer, sheet feed apparatus 25 can also be utilized in other electronic devices that manipulate or alter a sheet of media. For example, sheet feed apparatus 25 can also be used to feed individual sheets of media that are already have an image, wherein the electronic device scans or reads the image upon the sheet of media. In other applications, sheet feed apparatus 25 is utilized in an electronic device that is configured to cut, fold or otherwise alter the characteristics of the sheet 14 of media. In some embodiments, sheet feed apparatus 25 is provided as part of a module that is releasably connected to an electronic device.

The above discussion is meant to be illustrative of the principles and various embodiments. Numerous variations and modifications will become apparent to those skilled in the art once the above disclosure is fully appreciated. It is intended that the following claims be interpreted to embrace all such variations and modifications.

What is claimed is:

1. A sheet feed apparatus, comprising:

a mount pick arm that includes two arms, a first axis between the two arms, and a spacer wheel that rotates between the two arms about the first axis, one end of the two arms connects to the first axis and a second end pivotally attaches to a body of the sheet feed apparatus such that the second end of the two arms pivots at the body about a second axis to move the mount pick arm, the spacer wheel, and the two arms closer to a stack of media as media is picked from the stack of media;

a pick arm pivotally connected to the first axis between the two arms of the mount pick arm to pick media from the stack of media, wherein the two arms are spaced apart at opposite sides of the sheet feed apparatus.

2. The sheet feed apparatus of claim 1, wherein the spacer wheel and the pick arm abut an outer surface of an inner media tray when no media is present in the sheet feed apparatus and are displaced from the outer surface a distance equivalent to a height of a stack of media when the stack of media is present in the sheet feed apparatus.

3. The sheet feed apparatus of claim 1, further comprising another spacer wheel, and the pick arm, the spacer wheel, and the another spacer wheel abut a top sheet of the media to provide a consistent pick geometry throughout a full thickness of the stack of media.

4. The sheet feed apparatus of claim 1, further comprising a sheet feed gear system including plural gears for transmitting sheet feeding energy through the mount pick arm to the pick arm.

5. The sheet feed apparatus of claim 1, further comprising a locking system that prevents the mount pick arm from moving, the locking system being activated to lock the mount pick arm at a point in time when a pick of the media initiates.

6. The sheet feed apparatus of claim 1, further comprising a sheet feed gear system that generates a torque for compensating and adjusting a feeding force while picking the media.

7. A method, comprising:

moving a mount pick arm with spaced apart and parallel arms toward a stack of media each time a piece of media is removed from the stack of media;

picking the media with a pick arm that is pivotally connected between the arms of the mount pick arm, wherein the spaced apart and parallel arms pivotally connect at opposites sides of a body of a sheet feed apparatus; and utilizing a sheet feed gear drive to lock the mount pick arm into a position in order to obtain consistent pick performance of the media from the stack of media.

8. The method of claim 7, further comprising maintaining a consistent distance between the pick arm and the stack of media as the media is removed from the stack of media.

9. The method of claim 7, further comprising locking of the mount pick arm at a point in time when a printer is instructed to pick a sheet of the media.

10. The method of claim 7, further comprising:

abutting two spaced apart spacer wheels against the stack of media;

moving the two spaced apart wheels towards the stack of media as pieces of the media are removed from the stack of media.

11. A method, comprising:

moving a mount pick arm with spaced apart and parallel arms toward a stack of media each time a piece of media is removed from the stack of media;

picking the media with a pick arm that is pivotally connected between the arms of the mount pick arm, wherein the spaced apart and parallel arms pivotally connect at opposite sides of a body of a sheet feed apparatus; and maintaining a consistent angle between the pick arm and the stack of media while successive pieces of the media are picked from the stack of media.

12. A sheet feed apparatus, comprising:

a pick arm that picks pieces of stacked media;

a mount pick arm that includes two spaced apart arms having a first end pivotally connected at opposite sides of a body of an electronic device and a second end connected to an axis extending between the opposite sides, the pick arm is connected to and rotates about the axis and moves toward the pieces of stacked media as the first end pivotally rotates; and a sheet feed gear system that locks the mount pick arm into a stationary position before the pick arm picks a piece of the stacked media.

13. The sheet feed apparatus of claim 12, further comprising a mount pick arm lock that prevents the pick arm from moving away from the piece of the stacked media during a pick.

14. The sheet feed apparatus of claim 12, wherein the sheet feed gear system locks the mount pick arm at a point in time when the pick arm is instructed to pick the piece of the stacked media.

15. The sheet feed apparatus of claim 12, further comprising two spaced apart spacer wheels that abut the piece of the stacked media.

16. The sheet feed apparatus of claim 12, further comprising a mount pick arm lock that moves to lock the mount pick arm into the stationary position.

17. The sheet feed apparatus of claim 12, further comprising a first axis around which the pick arm rotates and a second axis around which the mount pick arm pivots toward the stacked media.

* * * * *

UNITED STATES PATENT AND TRADEMARK OFFICE

CERTIFICATE OF CORRECTION

PATENT NO. : 7,828,283 B2
APPLICATION NO. : 11/780460
DATED : November 9, 2010
INVENTOR(S) : Murray Learmonth et al.

It is certified that error appears in the above-identified patent and that said Letters Patent is hereby corrected as shown below:

In column 6, line 58, in Claim 7, delete “opposites” and insert -- opposite --, therefor.

Signed and Sealed this
Twelfth Day of April, 2011

David J. Kappos

David J. Kappos
*Director of the United States Patent and Trademark Office*